United States Patent [19]

Baumgärtel et al.

[11] 4,061,332

[45] Dec. 6, 1977

[54] ROLLER CONVEYOR

[75] Inventors: Karl Heinz Baumgärtel, Constance; Dieter Altenburg, Allensbach; Siegfried Häse, Constance, all of Germany

[73] Assignee: Licentia Patent-Verwaltungs-G.m.b.H., Frankfurt am Main, Germany

[21] Appl. No.: 698,817

[22] Filed: June 23, 1976

[30] Foreign Application Priority Data

July 1, 1975 Germany ..... 2529223

[51] Int. Cl.[2] ..... B65H 5/34

[52] U.S. Cl. ..... 271/270; 198/783; 198/789; 271/274; 185/37

[58] Field of Search ..... 198/608, 624, 780, 783, 198/788, 789; 271/270, 272–274; 193/35 A; 185/37; 192/148

[56] References Cited

U.S. PATENT DOCUMENTS

| | | | |
|---|---|---|---|
| 2,224,572 | 12/1940 | Harvey | 226/121 |
| 3,495,693 | 2/1970 | Limberger | 192/148 |
| 3,532,338 | 10/1970 | Brinson et al. | 271/273 |
| 3,851,810 | 12/1974 | Jespersen | 185/37 |

*Primary Examiner*—John J. Love
*Assistant Examiner*—Joseph E. Valenza
*Attorney, Agent, or Firm*—Spencer & Kaye

[57] ABSTRACT

A conveyor apparatus has at least one power-driven roller arrangement for a positive engagement and feed of an item in the conveying direction, and an incremental feed device situated downstream of the roller arrangement as viewed in the conveying direction. The incremental feed device includes an incremental feed roller spaced from the roller arrangement; an energy storing device connected to the incremental feed roller; and a mechanism for urging the item against the incremental feed roller for rotating the incremental feed roller by the item advanced by the roller arrangement to arm the energy storing device and for further advancing the item by the incremental feed roller during energy release by the energy storing device.

5 Claims, 1 Drawing Figure

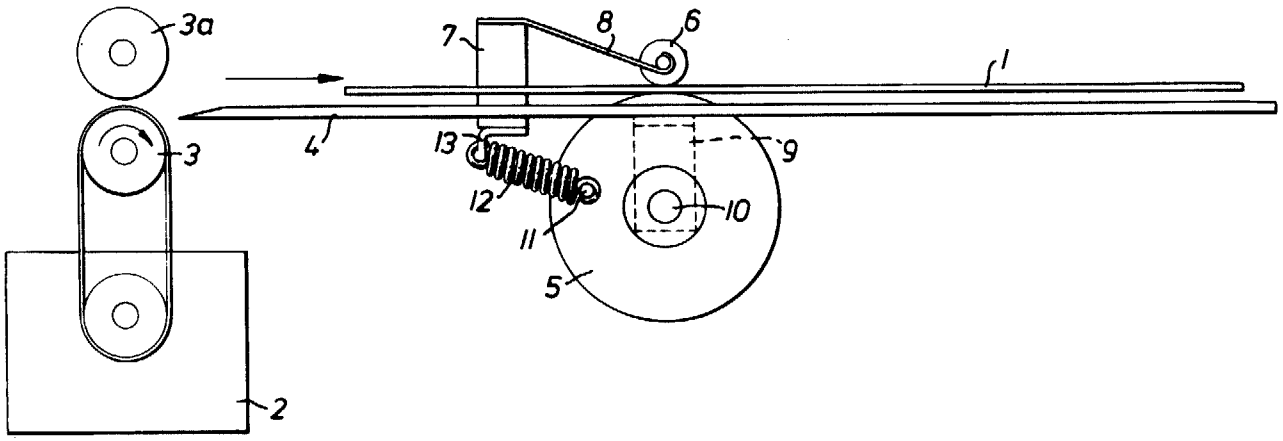
1
9
10
6
8
5
11
12
7
13
4
2
3a
3

ROLLER CONVEYOR

BACKGROUND OF THE INVENTION

This invention relates to a conveyor apparatus, particularly of the roller type, on which items are advanced towards its discharge end and which has at least one power-driven roller arrangement for the positive engagement and feed of the items.

SUMMARY OF THE INVENTION

It is an object of the invention to provide, in conjunction with the above-outlined apparatus, an economical device for effecting an additional, incremental feed of the items beyond the effective range of the power-driven roller arrangement.

This object and others to become apparent as the specification progresses, are accomplished by the invention, according to which, briefly stated, the conveyor apparatus has at least one power-driven roller arrangement for a positive engagement and feed of an item in the conveying direction and an incremental feed device situated downstream of the roller arrangement as viewed in the conveying direction. The incremental feed device includes an incremental feed roller spaced from the roller arrangement; an energy storing device connected to the incremental feed roller; and a mechanism for urging the item against the incremental feed roller for rotating the incremental feed roller by the item advanced by the roller arrangement to arm the energy storing device and for further advancing the item by the incremental feed roller during energy release by the energy storing device.

According to a preferred embodiment of the invention, the energy storing device is constituted by a tension spring which is armed in the course of a 180°-rotation of the incremental feed roller and which thereafter rotates the incremental feed roller through an additional 180° with the required conveying force.

According to an advantageous feature of the invention, the feed roller has a floating support and carries at its free side a pin, onto which the tension spring (stationarily attached at its other end) is hooked.

BRIEF DESCRIPTION OF THE DRAWING

The sole FIGURE is a schematic side elevational view of a preferred embodiment of the invention.

DESCRIPTION OF THE PREFERRED EMBODIMENT

The conveyor device illustrated in the drawing is particularly adapted to handle flat, letter-like items. Such an item 1 is first advanced towards the right by a roller 3 which is driven by a motor 2 and which cooperates with a counter roller 3*a*. As the rollers 3 and 3*a* advance the item 1, its leading end, sliding on a plate 4, is introduced into the bite of an incremental feed roller 5 and a pressure roller 6 which is firmly pressed downwardly by means of a leaf spring 8. The incremental feed roller 5 is thus arranged downstream of the power-driven roller arrangement 2, 3, 3*a*, as viewed in the direction of conveyance. One end of the leaf spring 8 is affixed to a bracket 7, while its other end carries the pressure roller 6. To the plate 4 there is affixed a downwardly extending bearing bracket 9 which supports only one end of the rotary shaft 10 of the incremental feed roller 5. In this manner a floating support is effected for the incremental feed roller 5. The latter has a drum shape and carries, at its side remote from the support bracket 9, a pin 11 whose distance from the axis of the roller shaft 10 constitutes an imaginary crank arm. One end of a tension spring 12 is hooked around the pin 11, while its other end is attached in a stationary manner to a post 13 affixed to the underside of the plate 4.

As the continuously rotating power-driven roller 3 advances the item 1 further towards the right, it rotates the incremental feed roller 5 clockwise by virtue of the firm pressure by the pressing roller 6. During this occurrence and until a 180° rotation of the incremental feed roller 5 is achieved, the tension spring 12 is progressively armed (tensioned). Shortly after exceeding a 180° angle of rotation, that is, upon passing the associated dead center, the spring 12 begins to contract and thus releases energy by virtue of which it transmits a torque about the shaft 10, so that the incremental feed roller 5 continues to rotate in the same direction until, after a full revolution, it assumes its position shown in the FIGURE. It is seen that the tension spring 12, the pin 11, the post 13 and their relationship to the axis of the shaft 10 form an over-the-center spring arrangement.

Thus, the incremental feed roller 5, as it is rotated by the contracting tension spring 12, advances the item 1 further towards the right in cooperation with the pressure roller 6. Since the incremental feed roller 5 is capable of advancing the item without the aid of the motor-driven roller arrangement 2, 3, 3*a* after the incremental feed roller 5 has passed its above above-noted dead center, the distance between the bite of the roller arrangement 2, 3, 3*a* and the bite of the roller arrangement 5, 6 should be so designed, that even in the case of the shortest possible item the trailing end of such item will clear the roller arrangement 2, 3, 3*a* only after the incremental feed roller has passed its dead center. As the feed roller 5 has executed a full revolution and is again in its position shown in the FIGURE, the item 1 reached a position on the plate 4 in which it is firmly and stationarily positioned by virtue of the cooperation between rollers 5 and 6 and the resiliently immobilizing effect of the tension spring 12.

The above described incremental feed device may be mounted on a movable carriage and thus "takes over" the item 1 from a stationary apparatus component (such as the roller arrangement 2, 3, 3*a*) and removes the item as the carriage is propelled away from the roller arrangement 2, 3, 3*a*. As seen, such a transfer of items and their immobilization can be effected in a very simple and advantageous manner by means of the device structured according to the invention without the necessity of providing any overlapping relationship between a forwarding component of the stationary apparatus component and the carriage or without the necessity of engaging the carriage by such component.

A conveying device as described above may further be used to achieve a particularly rapid ejection of the items. For this purpose the circumference of the incremental feed roller 5 is at least somewhat greater than the length of the item 1 in the direction of feed and the distance of the midpoints of the axes of rollers 3 and 5 is, in the direction of feed, at the most equal to one-half of the length of the item. By so dimensioning the device that the trailing end of the item 1 runs out of the bite of the cooperating rollers 5 and 6 after at least a ¾ revolution of the incremental feed roller 5, and a sufficiently powerful tension spring 12 is provided, there is achieved a high ejection speed for the item.

The above-described simple construction may also be used as an intermediate conveying arrangement in roller ways to make possible an increase of the distance between the power-driven conveyor rollers up to one and one-half times.

It will be understood that the above description of the present invention is susceptible to various modifications, changes and adaptations, and the same are intended to be comprehended within the meaning and range of equivalents of the appended claims.

What is claimed is:

1. In a conveyor apparatus having at least one power-driven roller arrangement for a positive engagement and feed of an item in the conveying direction, the improvement comprising an incremental feed device situated downstream of said roller arrangement as viewed in the conveying direction, said incremental feed device including a. an incremental feed roller spaced from said roller arrangement, each item being advanced into the zone of said incremental feed roller by said roller arrangement;

b. means for urging the item into frictional contact with the periphery of said incremental feed roller for rotating said incremental feed roller from a first position to a second position by said roller arrangement with the intermediary of the item being advanced; and c. an energy storing means connected to said incremental feed roller for being armed by said incremental feed roller during its rotation from said first position to said second position and for rotating said incremental feed roller from said second position towards said first position codirectionally with the rotation from the first position to the second position to further advance the item in said conveying direction.

2. A conveyor apparatus as defined in claim 1, wherein said means for urging the item into frictional contact with said incremental feed roller comprises a pressure roller resiliently urged against said incremental feed roller.

3. A conveyor apparatus as defined in claim 1, wherein said energy storing device comprises an over-the-center spring arrangement including a tension spring attached to said incremental feed roller for being armed thereby upon its rotation from a position of rest to a dead center position and for rotating said incremental feed roller by said tension spring in the same direction to said position of rest; said position of rest being said first position and said dead center position being said second position.

4. A conveyor apparatus as defined in claim 3, wherein the angle of rotation from said position of rest to said dead center is substantially 180°.

5. A conveyor apparatus as defined in claim 4, further comprising means for floatingly supporting said incremental feed roller on one side thereof; a pin affixed to the other, opposite side of said incremental feed roller at a distance from the rotary axis thereof, said pin supporting a first end of said tension spring; and means for stationarily attaching a second end of said tension spring.

* * * * *